US005448339A

United States Patent [19]

Kokaji et al.

[11] Patent Number: 5,448,339

[45] Date of Patent: Sep. 5, 1995

[54] CONTROL SYSTEM FOR HEAT FIXING APPARATUS

[75] Inventors: Norio Kokaji, Hino; Michiaki Yokozawa, Tokyo; Yuuichi Nakagawa; Mamoru Nishiguchi, both of Hino; Seiichi Hayashi, Fuchu, all of Japan

[73] Assignee: Iwatsu Electric Co., Ltd., Tokyo, Japan

[21] Appl. No.: 9,846

[22] Filed: Jan. 27, 1993

[30] Foreign Application Priority Data

Jan. 27, 1992 [JP] Japan ..... 4-011921

[51] Int. Cl.[6] ..... G03G 21/00; G03G 15/20

[52] U.S. Cl. ..... 355/208; 219/216; 355/285

[58] Field of Search ..... 355/205, 206, 207, 208, 355/282, 285–295; 219/216, 469–471

[56] References Cited

U.S. PATENT DOCUMENTS

| | | | |
|---|---|---|---|
| 3,926,519 | 12/1975 | Rebres | 355/208 |
| 4,162,847 | 7/1979 | Brandon | 219/216 X |
| 4,367,037 | 6/1983 | Nishikawa | 219/216 X |
| 4,480,908 | 11/1984 | Anzai et al. | 355/285 |
| 4,549,803 | 10/1985 | Ohno et al. | 219/216 X |
| 4,609,278 | 9/1986 | Taniguchi | 219/216 X |
| 4,737,818 | 4/1988 | Tanaka et al. | 219/216 X |
| 4,905,051 | 2/1990 | Satoh et al. | 355/290 |
| 4,914,476 | 4/1990 | Nishitsuji et al. | 355/290 X |
| 4,920,250 | 4/1990 | Urban | 355/285 X |
| 4,996,567 | 2/1991 | Natarai et al. | 355/290 |
| 5,001,519 | 3/1991 | Saito | 355/285 |
| 5,051,780 | 9/1991 | Stelter et al. | 355/285 X |

FOREIGN PATENT DOCUMENTS

| | | |
|---|---|---|
| 1-239579 | 9/1989 | Japan . |
| 3-38681 | 2/1991 | Japan . |
| 4-06580 | 1/1992 | Japan . |

*Primary Examiner*—A. T. Grimley
*Assistant Examiner*—Shuk Y. Lee
*Attorney, Agent, or Firm*—Paul & Paul

[57] ABSTRACT

The present invention is aimed at providing a control system for a thermal fixing apparatus having an excellent fixing ability even at an initial stage of a copying process when applied to a high speed copying machine and ensuring a longer life of a surface layer member of the roller, while maintaining the economical benefit derived from the provision of a heater only in a heat roller. The fixing apparatus includes a heater roller 101 and a press roller 102. At least one of the rollers is driven by a motor 103 while in contact with the other so that both rollers are rotated together. A surface temperature of the heater roller 101 is detected by a thermometer 104 and is used for controlling a heating level of a heater 106 by a controller 105. A standby stage controller 110 stops the rotation of the motor 103 if it is determined that the surface temperature of the press roller detected by a thermometer 107 is higher than the upper limit temperature, and outputs a command for rotating the motor 103 if it is determined that the surface temperature of the press roller is lower than the lower limit temperature.

4 Claims, 11 Drawing Sheets

CONTROL SYSTEM FOR HEAT FIXING APPARATUS

BACKGROUND OF THE INVENTION

1. Field of the Invention

The present invention relates to a control system for a heat fixing apparatus used in a copying machine or a printer. Particularly, it relates to a control system for a fixing apparatus used in a super-high speed copying machine or a printer, provided with a heating means only in one roller.

2. Description of the Related Arts

It is well-known to apply a heat fixing apparatus using in a copying machine or the like for fixing an image printed by toner.

Generally in this type of a heat fixing apparatus, a heater roller having a built-in heater is in contact with a press roller and rotates together with the latter, whereby a paper printed by toner passes between these rollers so that toner can be fixed on the paper. In this case, it is important for achieving stable fixing that the temperatures of the heater roller and the press roller must be maintained as closer as possible to a predetermined value.

It is publicly known that the heater roller and the press roller are rotated together for a predetermined time, while being in contact with each other, to uniformly warm up the press roller with heat generated at the heater roller (see, for example, Japanese Examined Patent Publication (Kokoku) No. 61-31462).

Also, it has been proposed that the heater roller start rotating while in contact with the press roller at a first target temperature that is lower than a predetermined standby temperature and stop rotating at a second target temperature that is higher than the first target temperature (see, for example, Japanese Examined Patent Publication (Kokoku) No. 61-31463).

In these prior arts, however, in the case that the apparatus stops for a long period after the warming-up operation or that a copying interval becomes longer, the temperature of the heater roller lowers significantly and inferior fixing occurs, because the temperature of the press roller is lowered considerably during the standby period, whereby a large amount of heat is transferred to the press roller from the heater roller at the initial stage of the copying process.

In a low speed copying machine, even if a temperature drop in the heater roller occurs, there is sufficient time to recover the temperature and no fixing problems may occur. On the contrary, in a high speed copying apparatus having a capacity of, for example, 100 sheets per minute, several sheets of paper may pass through a fixing apparatus before the temperature reaches the predetermined temperature, whereby the temperature drop in the heater roller has a significant influence.

FIG. 11 is a chart for explaining the above problems inherent in the prior art copying machine, in which the abscissa and ordinate represent time and the surface temperature of rollers, respectively.

That is, in the case that a surface temperature TP of the press roller is at greatly low value, a surface temperature TH of the heater roller is lowered once from $TH_1$ to $TH_2$ during a period between time $t_1$ and $t_2$, and the surface temperature TP of the press roller rises from $TP_1$ to $TP_2$.

When the surface temperature TH of the heater roller is lowered, a heater is energized to warm-up the heater roller, but if a silicone rubber having a lower thermal conductivity is used as a surface layer of the heater roller, the surface temperature TH reaches an optimal temperature $TH_3$ at a delayed time $t_3$.

In a high speed copying machine, since several sheets of paper may pass through the rollers during a period between $t_2$ and $t_3$, the occurrence of inferior fixing cannot be prevented.

A hard roller having a surface layer member of fluorine resin (such as TEFLON®) has been used in the heat fixing apparatus, however, this roller has a drawback in that an image obtained after the fixing process becomes too glossy to be favored. Therefore, a soft roller using a silicone rubber as a surface layer member is favorable from the view point of an improvement in image quality. Since silicone rubber has a lower thermal conductivity, however, the temperature controlability of the heater roller and the press roller is worsened. In addition, since the heat durability thereof is insufficient, the temperature of the heater roller cannot be raised to a higher level.

To solve the above problems in the prior arts, it is proposed that a heater be provided not only in the heater roller but also in the press roller, and both rollers be maintained at substantially the same temperature (see, for example, Japanese Examined Patent Publication (Kokoku) No. 2-10427).

The fixing apparatus in which two heaters are provided in both the rollers can be suitably applied to a high speed copying machine, but is expensive due to the provision of two heaters, and also has a large power consumption.

SUMMARY OF THE INVENTION

The object of the present invention is to solve the above problems in the prior arts and to provide a control system for a heat fixing apparatus having excellent fixing ability even at an initial stage of a copying process when applied to a high speed copying machine and ensuring a longer life of a surface layer member of the roller, while maintaining the economic benefits derived from the provision of a heater only in a heater roller.

According to the present invention, prior to the issuance of a paper-feed command, a heat transfer from a heater roller to a press roller is carried out so that the temperature of the press roller is raised to $TP_4$ ($>TP_1$), as shown by a dotted line in FIG. 11, whereby a temperature drop in the heater roller is minimized ($TH_1 \rightarrow TH_4$, $TH_4 > TH_2$) during a period between $t_1$ and $t_2$ so that the surface temperature of the heater roller returns to $TH_3$ at $t_2$. As a result, even in a high speed copying machine, acceptable fixing can be realized after $t_2$.

FIG. 1 is a functional diagram showing a first aspect of the present invention, comprising a heater roller 101 covered by a surface layer having a release property and a press roller 102 also covered by a surface layer having a release property and arranged in contact with the heater roller 101.

Generally, the heater roller 101 is driven by a motor 103, and the press roller 102 rotates together with the heater roller 101 due to a frictional contact therebetween.

The surface temperature of the surface layer covering the heater roller 101 is detected by a temperature detecting means 104 and a control calculation is carried out based on a difference between the detected surface temperature of the heater roller and a predetermined target temperature.

An amount of heat generated by a heater 106 provided in the center of the heater roller 101 is controlled in accordance with the output from a control means 105 for the surface temperature of the heater roller.

The surface temperature of the surface layer that covers the press roller 102 is detected by a press roller surface temperature detecting means 107, the output of which is applied to a standby stage upper limit temperature determining means 108 for determining whether or not the surface temperature of the press roller at a standby stage is higher than a predetermined upper limit temperature, and also to a standby stage lower limit temperature determining means 109 for determining whether or not the surface temperature of the press roller at a standby stage is lower than a predetermined lower limit temperature.

A standby stage control means 110 stops the motor 103 when the standby stage upper limit temperature determining means 108 determines that the surface temperature of the press roller is higher than the upper limit temperature, and conversely issues a command to rotate the motor 103 when the standby stage lower limit temperature determining means 109 determines that the surface temperature of the press roller is lower than the lower limit temperature.

FIG. 2 is a functional diagram of a second aspect of the present invention, in which an initial stage lower limit temperature determining means 119 is provided for determining whether or not the surface temperature of the press roller at an initial stage of the copying process is lower than a predetermined lower limit temperature.

An initial stage control means 120 immediately outputs a paper-feed command when the initial stage lower limit temperature determining means 119 determines that the surface temperature of the press roller is higher than the lower limit temperature. Conversely, when the initial stage lower limit temperature determining means 119 determines that the surface temperature of the press roller is lower than the lower limit temperature, the initial stage control means 120 outputs a command to rotate the motor 103, and thereafter outputs a paper-feed command when it determines that the surface temperature of the press roller has become higher than the lower limit temperature.

In a third aspect of the present invention, a copying stage heater control means 130 is added to the system of the second aspect. When the start-up stage lower limit temperature determining means 119 determines that the surface temperature of the press roller is lower than the lower limit temperature, the copying stage heater control means 130 controls the heater so that the heating level is maintained substantially at a maximum level irrespective of the control signal derived from the control means 105 for the surface temperature of the heater roller until the lowering of the surface temperature of the heater roller detected by the temperature detecting means 104 has stopped.

FIG. 3 is a functional diagram of a fourth aspect of the present invention, in which an end stage upper limit temperature determining means 138 for determining whether or not the surface temperature of the press roller detected by the surface temperature detecting means 107 at an end stage of the copying process is higher than a predetermined upper limit temperature and an end stage lower limit temperature determining means 139 for determining whether or not the surface temperature of the press roller detected by the surface temperature detecting means 107 at the end stage of the copying process is lower than a predetermined lower limit temperature are provided.

An end stage control means 140 outputs a command for stopping the rotation of the motor 103 when the end stage upper limit temperature determining means 138 determines that the surface temperature of the press roller is higher than the upper limit temperature, and outputs a command for initiating the rotation of the motor 103 when the end stage lower limit temperature determining means 139 determines that the surface temperature of the press roller is lower than the lower limit temperature.

In a fifth aspect of the present invention, the system of the fourth aspect is combined with the system of the first aspect so that the surface temperature of the press roller can be maintained within a range between the predetermined upper and lower limit temperatures not only at the standby stage but also after the copying process has been completed.

According to a sixth aspect of the present invention, the initial stage lower limit temperature determining means 119 is added to the system of the fourth aspect, for determining whether or not the surface temperature of the press roller detected by the surface temperature detecting means 107 is lower than a predetermined lower limit temperature during the copying process.

The start-up stage control means 120 immediately outputs a paper-feed command when the initial stage lower limit temperature determining means 119 determines that the surface temperature of the press roller is higher than the lower limit temperature. Conversely, when the initial stage lower limit temperature determining means 119 determines that the surface temperature of the press roller is lower than the lower limit temperature, the initial stage control means 120 outputs a command to rotate the motor 103, and thereafter outputs a paper-feed command when it determines that the surface temperature of the press roller has become higher than the lower limit temperature.

In a seventh aspect of the present invention, a copying stage heater control means 130 is added to the system of the sixth aspect. When the initial stage lower limit temperature determining means 119 determines that the surface temperature of the press roller is lower than the lower limit temperature, the copying stage heater control means 130 controls the heater so that the heating level is maintained at a substantially maximum level irrespective of the output signal derived from the control means 105 for the surface temperature of the heater roller until the surface temperature lowering of the heater roller detected by the temperature detecting means 104 has stopped.

According to the first aspect, whenever the surface temperature of the press roller is lowered at the standby stage, the motor drives both the rollers so that heat in the heater roller is transferred to the press roller, whereby the surface temperature of the press roller is maintained within the predetermined range. Thus the temperature drop in the heater roller is minimized, resulting in excellent fixing.

According to the second aspect, when the surface temperature of the press roller is lowered at the initial stage of the copying process, both rollers are rotated until the temperature is reached at which a required fixing result is ensured and then the paper-feed command is output.

According to the third aspect, in the case that the surface temperature of the press roller is lowered at the initial stage of the copying process, the heating level of the heater in the heater roller is maintained at a substantially maximum level so that the surface temperature of the press roller is rapidly raised and the drop in the surface temperature of the heater roller is compensated as soon as possible.

According to the fourth aspect, since both the rollers are continuously driven to by the motor rotate together even after the completion of the copying process, the heat in the heater roller is transferred to the press roller and the surface temperature of the press roller is raised over the predetermined temperature, whereby excellent fixing can be obtained at the initial stage of a subsequent copying process.

According to the fifth aspect, since the surface temperature of the press roller is maintained not only within the predetermined range at the standby stage but also over the predetermined temperature after the completion of the copying process, excellent fixing results at the initial stage of both current and subsequent copying processes.

According to the sixth aspect, when the surface temperature of the press roller is lowered at the initial stage of a subsequent copying process, both the rollers are rotated together so that the surface temperature of the press roller is raised over the temperature at which excellent fixing can be ensured and thereafter the paper-feed command is output.

According to the seventh aspect, when the surface temperature of the press roller is lowered at the initial stage of a subsequent copying process, the heating level of the heater in the heater roller is maintained at a substantially maximum level so that the surface temperature of the press roller is rapidly raised.

BRIEF DESCRIPTION OF THE DRAWINGS

The present invention will be described in more detail with reference to the preferred embodiments illustrated in the attached drawings; wherein.

DESCRIPTION OF THE PREFERRED EMBODIMENTS

Figure 1:
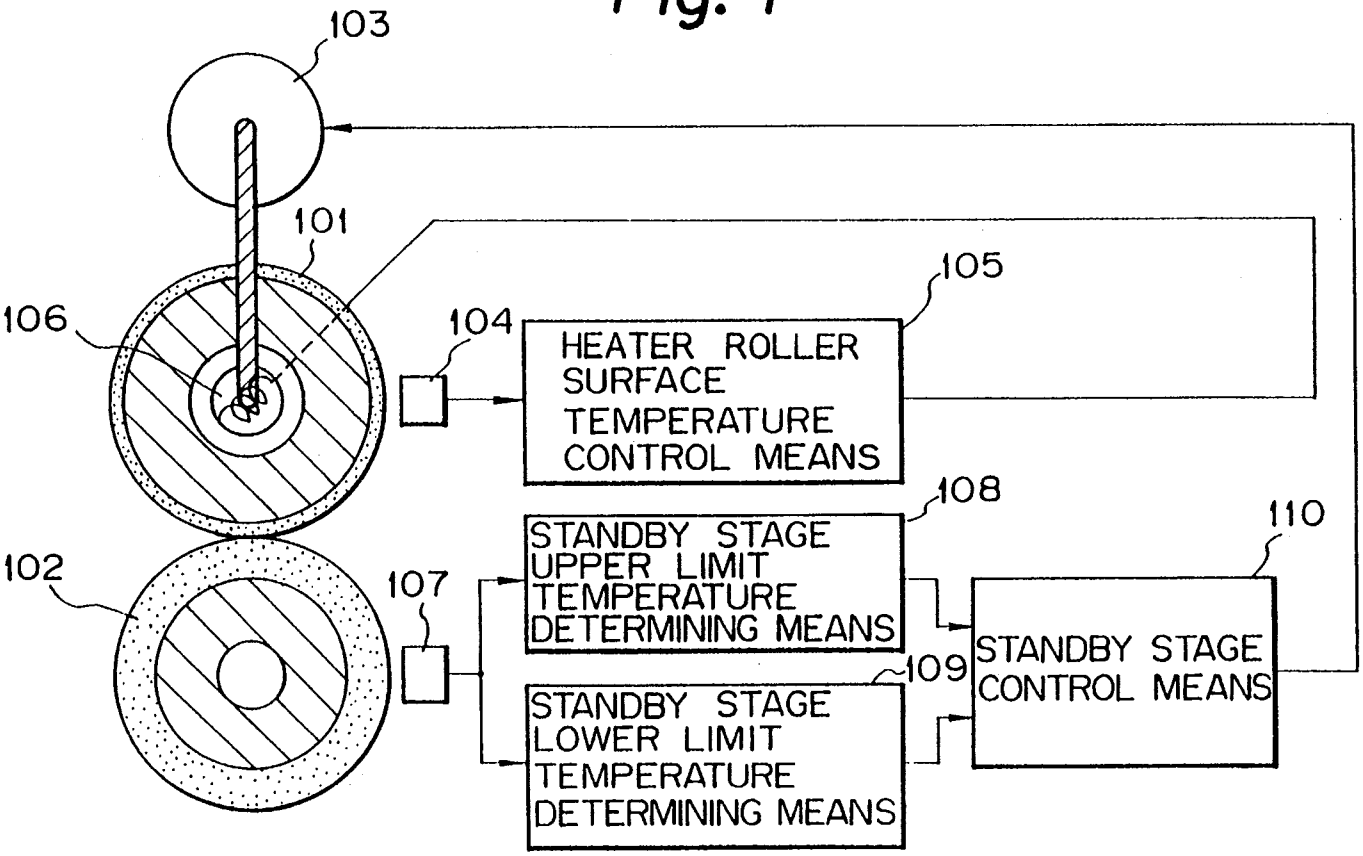
FIG. 1 is a functional diagram of a control system for a heat fixing apparatus according to a first aspect of the present invention.
Figure 2:
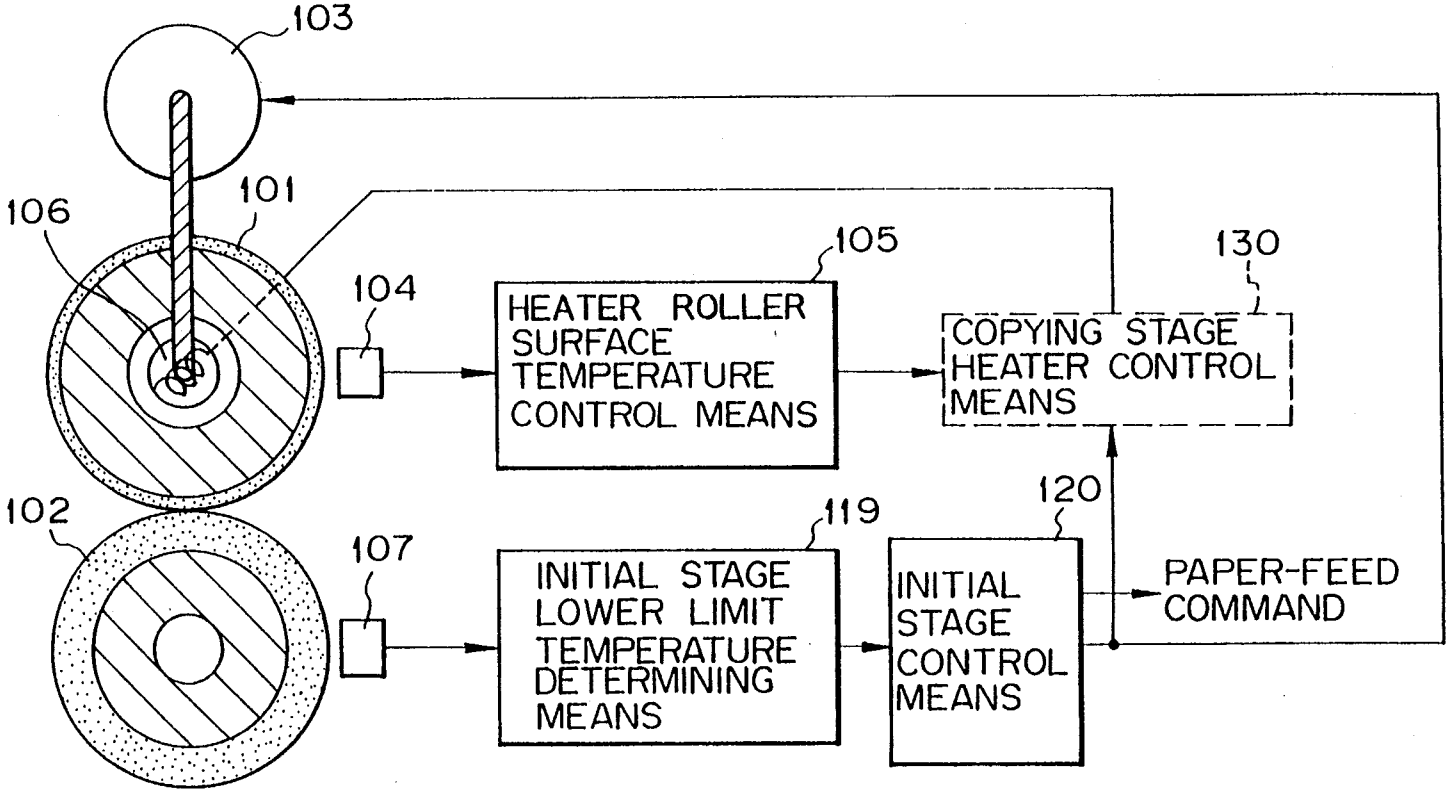
FIG. 2 is a functional diagram of a control system for a heat fixing apparatus according to second and third aspects of the present invention.
Figure 3:
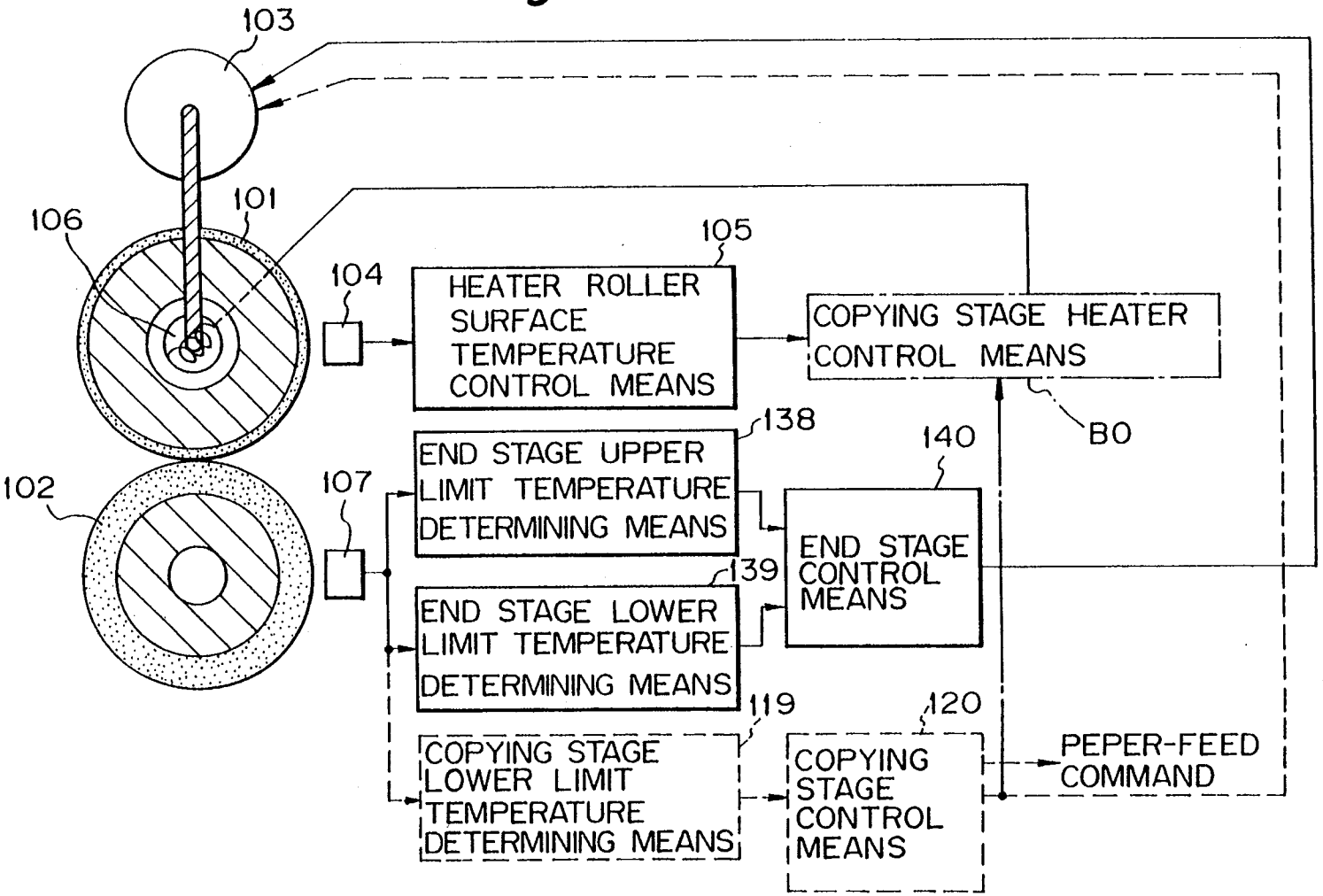
FIG. 3 is a functional diagram of a control system for a heat fixing apparatus according to fourth, fifth and sixth aspects of the present invention.
Figure 4:
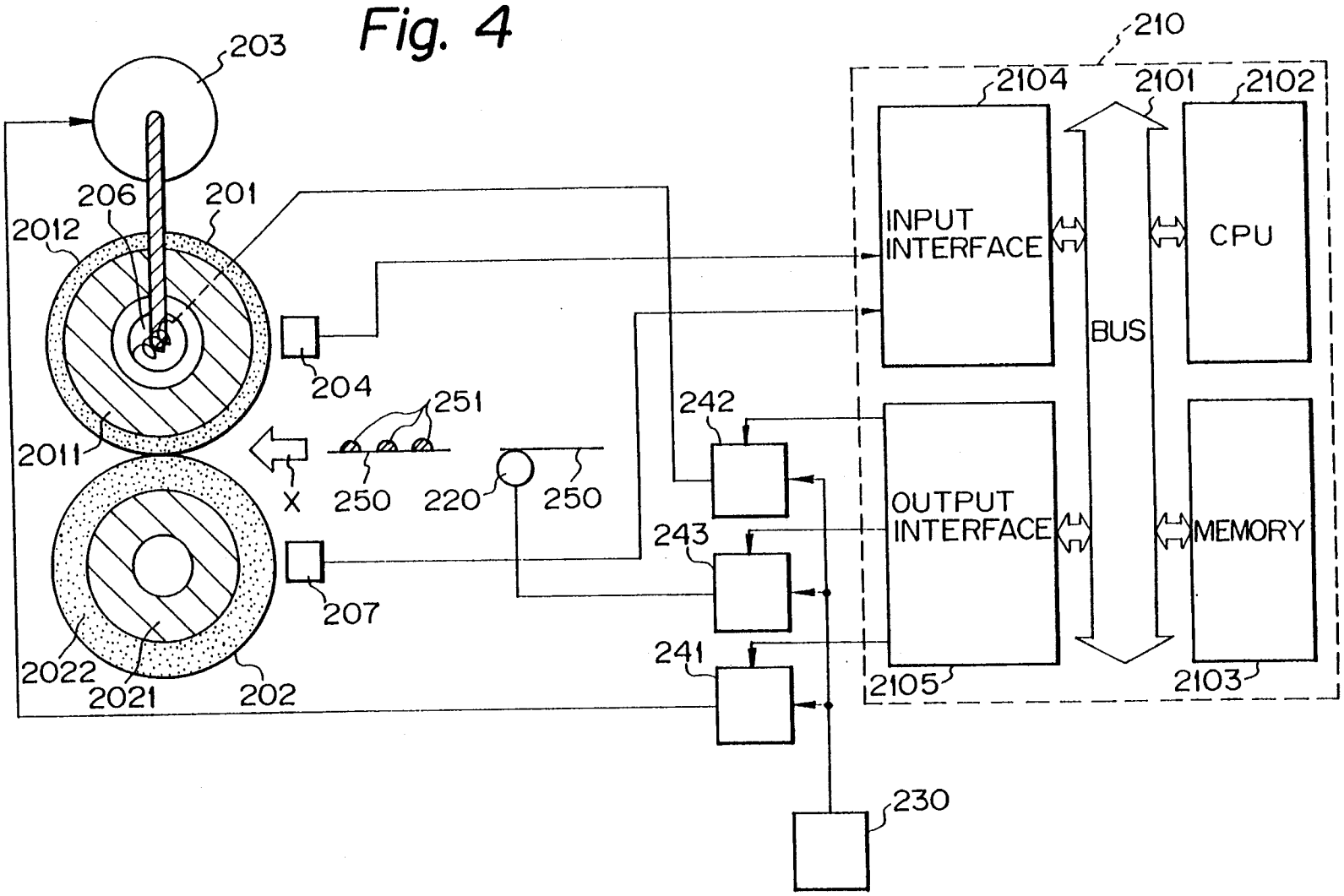
FIG. 4 is a schematic view of a control system according to one embodiment of the present invention.

FIG. 4 is a schematic view of a control system for a heat fixing apparatus according to the present invention, in which the heat fixing apparatus comprises a heater roller 201 and a press roller 202 in contact with each other. The heater roller 201 is connected with a motor 203. Accordingly, when the motor 203 rotates, the heater roller 201 is driven thereby to rotate and the press roller 202 also rotates by the frictional contact with the heater roller 201.

Each of the heater roller 201 and press roller 202 consists of a cylindrical core 2011 or 2021 and a surface layer 2012 or 2022 covering the outer periphery thereof made of a material having a release property such as silicone rubber.

A heater 206 is provided at the core of the heater roller 201 for heating the same. Heat stored in the heater roller 201 is transferred to the press roller 202 by contact therewith. The respective surface temperature of each the roller is made uniform by rotating the rollers with the motor 203.

The surface temperatures of the heater roller 201 and the press roller 202 are detected by thermometers 204 and 207 comprised of, for example, thermistors, and the detected signals are applied to a controller 210.

The controller 210 is, for example, a microcomputer system comprising a bus 2101, a CPU 2102, a memory 2103, an input interface 2104 and an output interface 2105. Detected signals of the two thermometers 204, 207 are fetched into the controller 210 through the input interface 2104.

Electrical power is supplied from an AC or DC power source 230 to the motor 203, the heater 206 and a paper-feed mechanism 220. Three switches 241, 242 and 243, comprised of, for example, solid state relays, are respectively provided between the power source 230 and each of the motor 203, heater 206, and paper-feed mechanism 220. These switches 241, 242 and 243 are controlled in an on/off manner by operation commands output from the output interface 2105.

An image is formed by toner 251 on a paper 250 fetched by the paper-feed mechanism 220 while the paper passes through a paper-feed path. Thereafter the paper proceeds in a direction marked X in the FIG. 4, and is gripped between the heater roller 201 and the press roller 202, at which point the toner image is thermally fixed on the paper.

Figure 5:
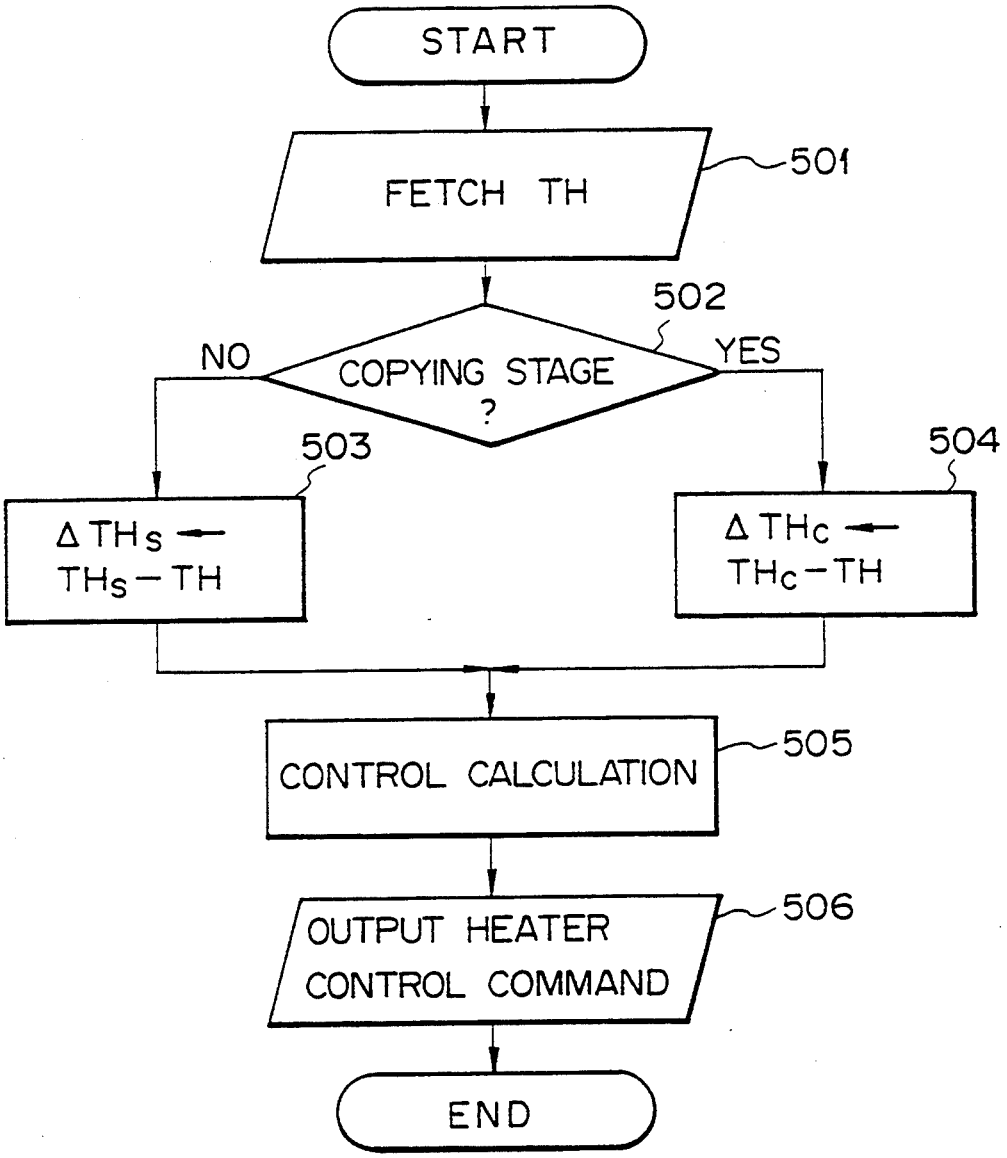
FIG. 5 is a flowchart for a first heater control routine.

FIG. 5 shows a first routine for controlling the heater executed in the controller 210 at predetermined time intervals.

At step 501, the surface temperature of the heater roller 201 TH is detected by the thermometer 204 and fetched via the input interface 2104.

At step 502, it is determined whether a machine is at a copying stage or a standby stage.

If the determination at step 502 is negative, that is, when the machine is at a standby stage, the control proceeds to step 503, at which a temperature deviation $\Delta TH_S$ between a standby stage heater roller set temperature $TH_S$ and TH is calculated, and thereafter the control proceeds to step 505.

If the determination at step 502 is affirmative, that is, when the machine is at a copying stage, the control proceeds to step 504, at which a temperature deviation $\Delta TH_C$ between a copying stage heater roller set temperature $TH_C$ and TH is calculated, and thereafter the control proceeds to step 505.

At step 505, a control calculation, for example, a proportional integral calculation is executed based on the deviation $\Delta TH_S$ or $\Delta TH_C$, the result of which is output at step 506.

A heater control command output at step 506 is transmitted to the switch 242, whereby the amount of heat from the heater 206 is regulated. This heating level regulation is achieved by controlling a time interval ratio between an on state and an off state in the switch 242.

Accordingly, the surface temperature of the heater roller TH is controlled to be within a predetermined range centered at the standby stage heater roller set temperature $TH_S$.

Figure 6:
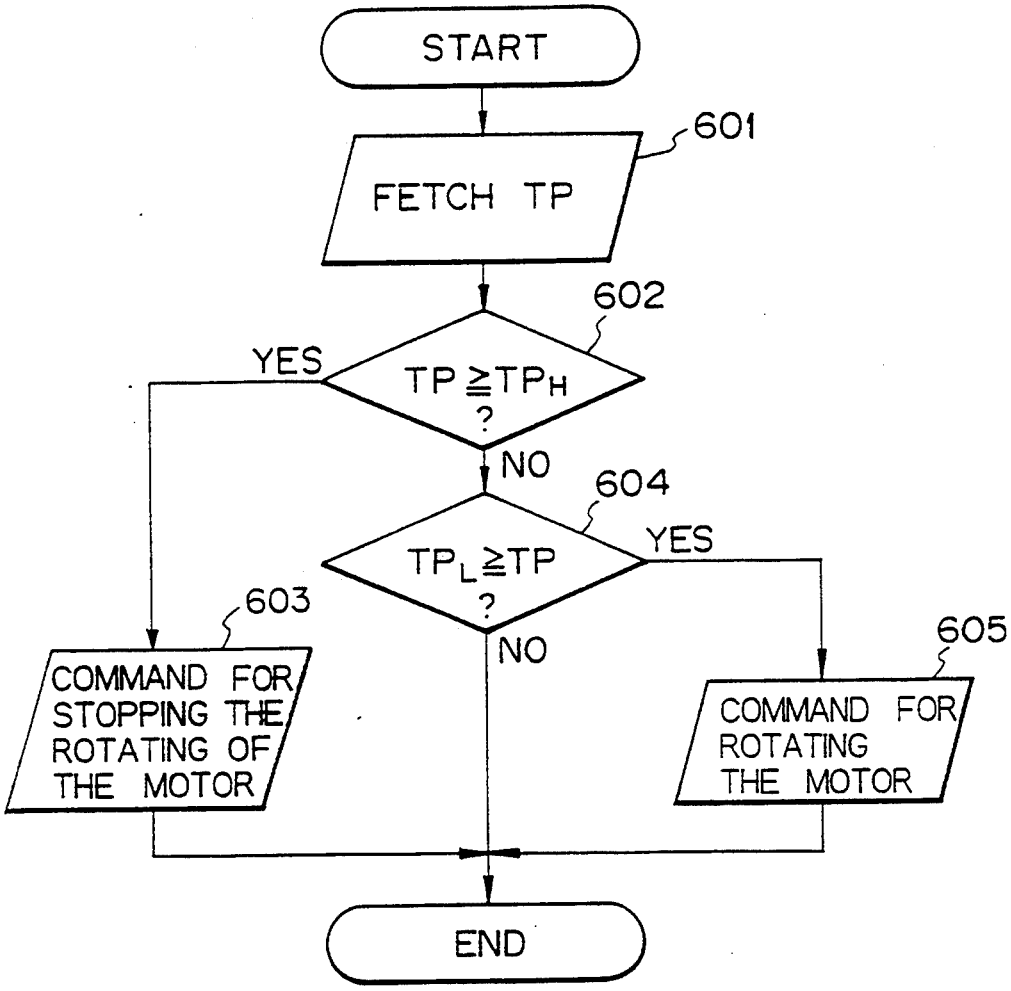
FIG. 6 is a flowchart for a temperature control routine for the press roller at a standby stage.

FIG. 6 illustrates a routine according to the present invention for controlling a standby stage press roller temperature executed in the controller 210 at predetermined time intervals.

At step 601, a surface temperature TP of the press roller detected by the thermometer 207 is fetched into the controller 210 via the input interface 2104.

At step 602, it is determined whether or not the surface temperature of the press roller TP is higher than a predetermined standby stage upper limit temperature $TP_H$.

If the determination at step 602 is affirmative, the control proceeds to step 603, at which an off command for the switch 241 is output via the output interface 2105 so that the rotation of motor 203 stops. Thereafter the control is completed.

If the determination at step 602 is negative, the control proceeds to step 604, at which it is determined whether or not the surface temperature TP of the press roller is lower than a predetermined standby stage lower limit temperature $TP_L$.

If the determination at step 604 is affirmative, the control proceeds to step 605, at which an on command for the switch 241 is output via the output interface 2105 so that the motor 203 rotates. Thereafter the control is completed.

If the determination at step 604 is negative, the control is completed without any further operations, and the motor is maintained in a rotating state or a stopped state depend on whether the surface temperature TP of the press roller is in a range lower than the warming-up stage upper limit temperature $TP_H$ or higher than the warming-up stage lower limit temperature $TP_L$.

Figure 7:
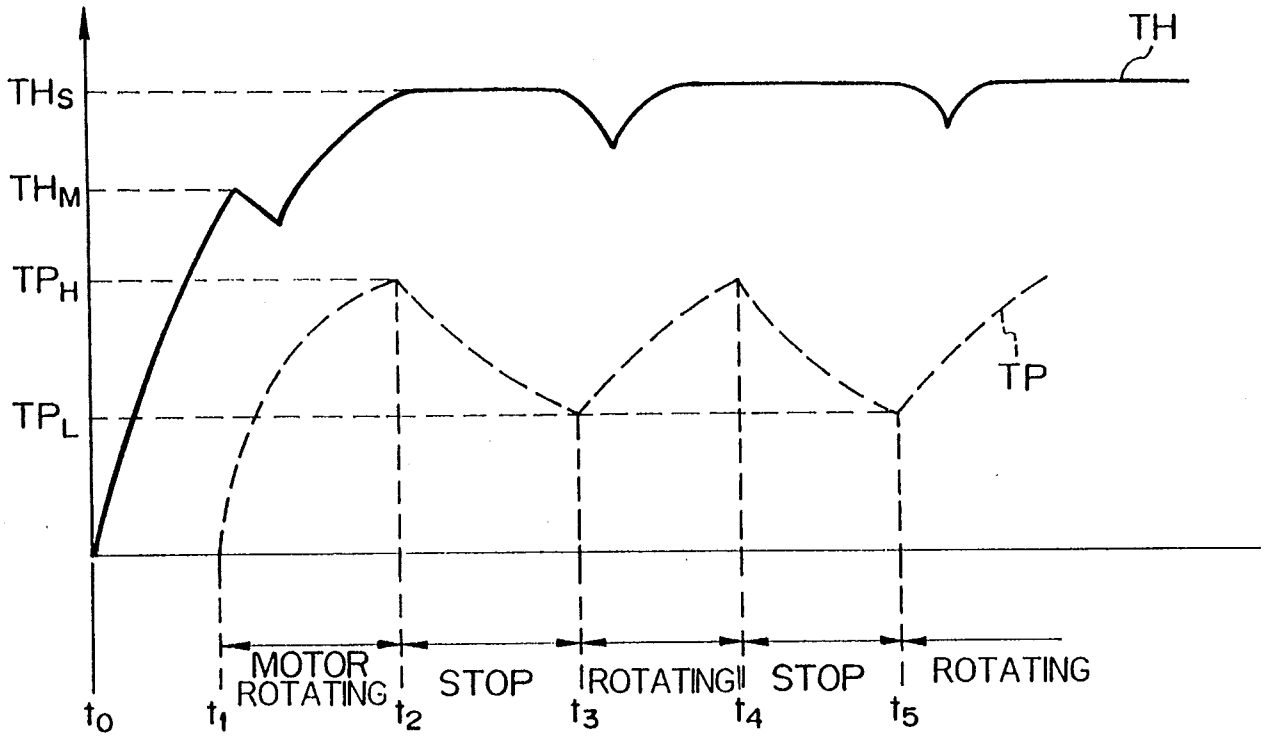
FIG. 7 is a graph explaining states of temperature control by the first aspect of the present invention.

FIG. 7 is a graph explaining states of temperature control by the first aspect of the present invention, in which the abscissa and ordinate represent time and roller temperature, respectively.

When the electrical power is supplied at time $t_O$, the warming-up of the heater roller 201 by the heater 206 is initiated and the surface temperature TH of the heater roller is gradually raised.

The motor 203 starts to rotate at time $t_1$, at which the surface temperature of the heater roller TH has reached a start-up stage lower limit temperature $TH_M$ that is lower than the standby stage set temperature $TH_s$ and higher than the melting temperature of the toner.

The surface temperature of the press roller TP is also gradually raised by the heat transfer to the press roller 202 from the surface of the heater roller while both the rollers are rotated together.

When the surface temperature of the heater roller TH reaches the standby stage heater roller set temperature $TH_S$ at time $t_2$ and the surface temperature of the press roller TP reaches the warming-up upper limit temperature $TP_H$, the rotation of the motor 203 is stopped. In this connection, the warming-up upper limit temperature of the press roller $TP_H$ is determined to be equal or substantially equal to the standby stage set temperature of the heater roller $TH_S$.

The surface temperature of the press roller TP is then gradually lowered, and when it reaches the standby stage lower limit temperature of the press roller $TP_L$ at time $t_3$, the motor 203 restarts its rotation.

As a result, the surface temperature is gradually raised, and when it reaches the standby stage upper limit temperature of the heater roller $TP_H$ at time $t_4$, the motor 203 stops its rotation.

As described above, as long as the machine is in a standby state, the surface temperature of the press roller TP is maintained between the standby stage upper limit temperature $TP_H$ and the standby stage lower limit temperature $TP_L$.

In the case where the warming-up of the press roller has already been completed, the idle rotation of the heater roller 201 and the press roller 202 and the paper-feeding are simultaneously initiated, whereby a paper is fetched by the rollers after the surface temperature of the press roller TP and that of the heater roller TH have reached a steady state temperature for the fixing operation, and excellent fixing can be obtained even on a first fed paper.

Figure 8:
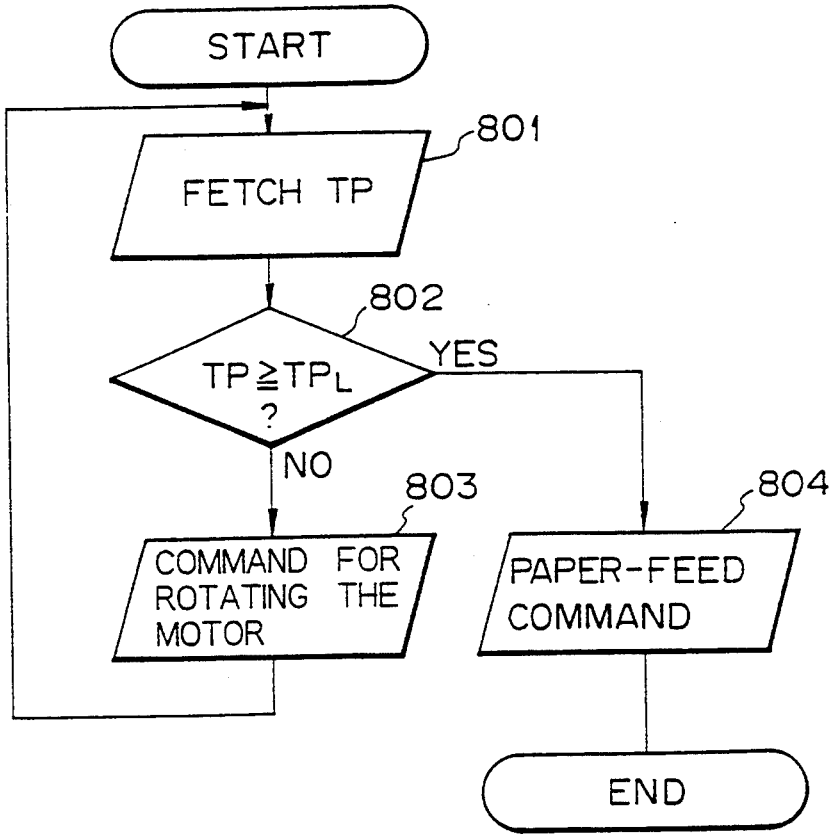
FIG. 8 is a flowchart for a temperature control routine of the press roller at an initial stage of a copying process.

FIG. 8 is a flowchart for a temperature control routine of the press roller at an initial stage of a copying process.

At step 801, the surface temperature of the press roller TP is fetched.

At step 802, it is determined whether or not the surface temperature of the press roller TP is higher than the start-up stage lower limit temperature $TP_L$.

If the determination at step 802 is negative, that is, if the surface temperature of the press roller TP is not higher than the start-up stage lower limit temperature $TP_L$, the control proceeds to step 803, at which a command for rotating the motor 203 is output and the control returns to step 801. The surface temperature of the press roller TP, therefore, is raised.

Contrarily, if the determination at step 802 is affirmative, that is, if the surface temperature of the press roller TP is higher than the start-up stage lower limit temperature $TP_L$, the control proceeds to step 804, at which a paper-feed command is output via the output interface 2105.

The switch 243 then enters an on state to activate the paper-feed mechanism 220, whereby a paper 250 having a toner image thereon is fed between the heater roller 201 and the press roller 202 for the fixing operation.

Figure 9:
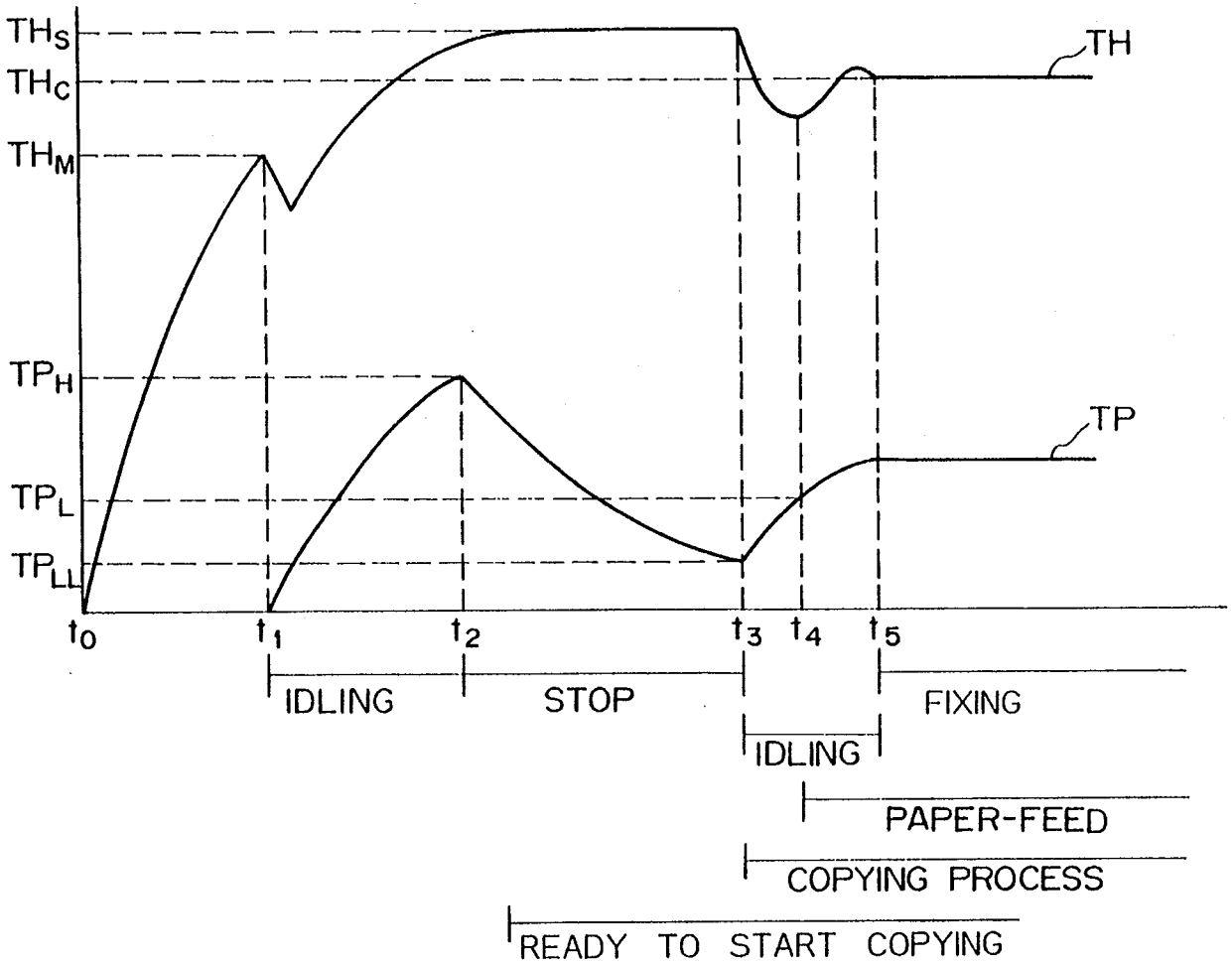
FIG. 9 is a graph explaining states of temperature control in the press roller by the second aspect of the present invention.

FIG. 9 is a graph explaining states of temperature control in a press roller by the second aspect of the present invention, in which the abscissa and ordinate represent time and temperature, respectively.

When an electrical power is supplied at time $t_0$, the heating of the heater roller is initiated by the heater 206 and the surface temperature of the heater roller TH is gradually raised.

The motor 203 begins to rotate at time $t_1$, at which the surface temperature of the heater roller TH reaches start-up stage lower limit temperature $TH_M$ that is lower than the standby stage set temperature $TH_s$ and higher than a melting point of the toner.

Also the surface temperature of the press roller TP is gradually raised due to the heat transferred from the surface of the heater roller 201 to the press roller 202 while both the rollers are rotating together.

When the surface temperature of the press roller TP has reached the warming-up stage upper limit temperature $TP_H$ at time $t_2$, the motor 203 stops rotating. If the surface temperature of the heater roller TH is Substantially equal to the standby stage set temperature $TH_S$ at this instant, the copying machine is ready to start copying.

If the surface temperature of the press roller TP is lowered to a temperature $TP_{LL}$ that is lower than the standby stage lower limit temperature $TP_L$ when a copy command is output at time $t_3$ after leaving the machine as it is, the motor 203 begins to rotate and the surface temperature of the press roller TP is raised again. During this operation, a heating level of the heater 206 is controlled so that the lowering of the surface temperature of the heater roller TH is prevented.

If the lowering of the surface temperature of the heater roller TH stops and the surface temperature of the press roller TP is higher than the standby stage lower limit temperature $TP_L$ at time $t_4$, the paper-feeding is initiated. The toner image is fixed after time $t_5$, at which stage excellent fixing can be achieved because the surface temperature of the heater roller TH is returned to the copying stage set temperature $TH_C$.

The third aspect of the present invention is aimed at positively restricting the lowering of the surface temperature of the heater roller TH at a start-up stage of the copying process. That is, if the surface temperature of the press roller TP is lower than the initial stage lower limit temperature $TP_L$ in the second aspect, the heat stored in the heater roller 201 is transferred to the press roller due to the rotation of the motor 203, which causes a drop in the surface temperature of the heater roller 201. Accordingly, there is a drawback in that a considerable amount of time may be required before the issuance of the paper-feed feed command at the initial stage of the copying process. The third aspect is aimed at solving this drawback.

Figure 10:
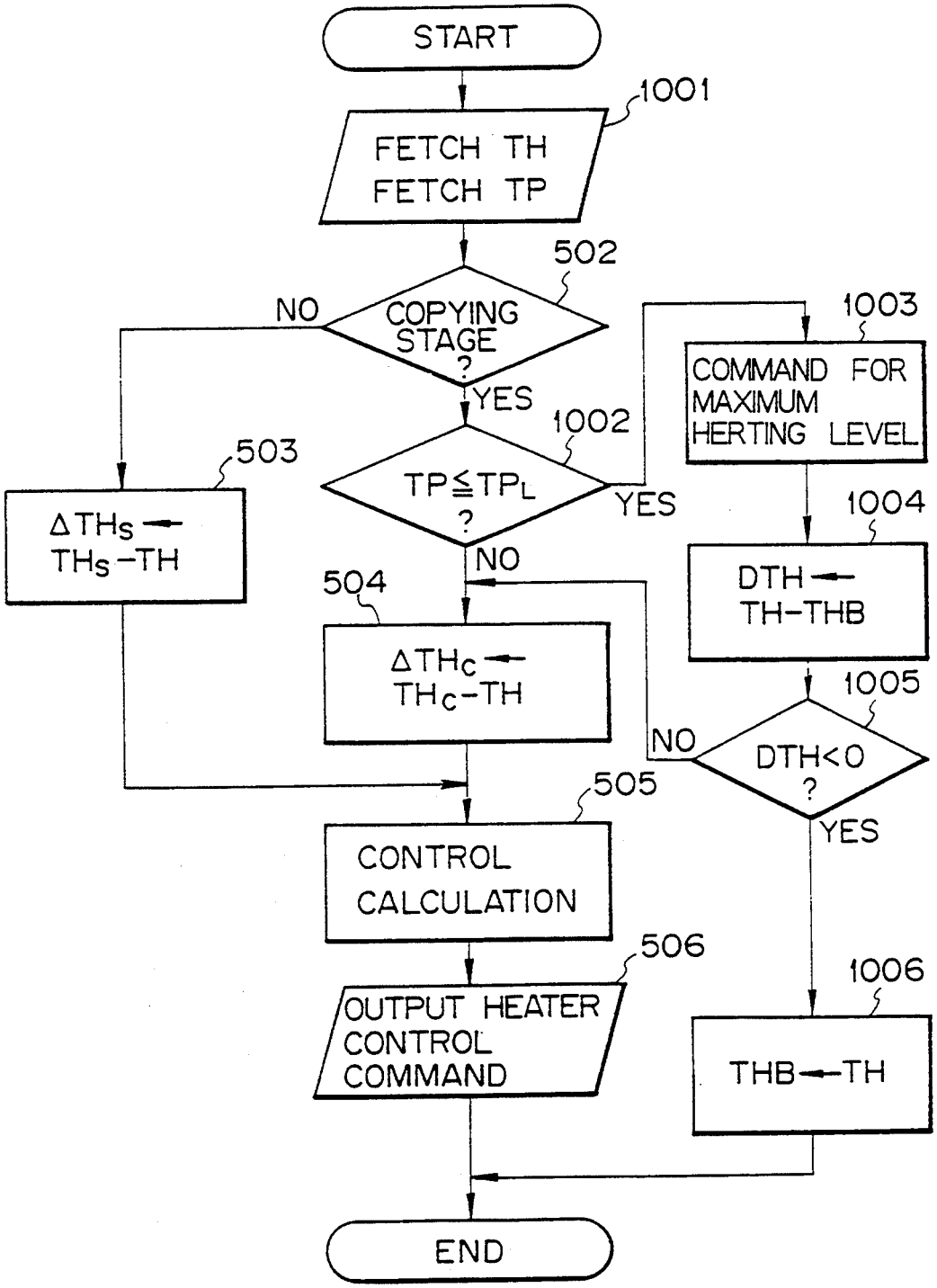
FIG. 10 is a flowchart for a second heater control routine.
Figure 11:
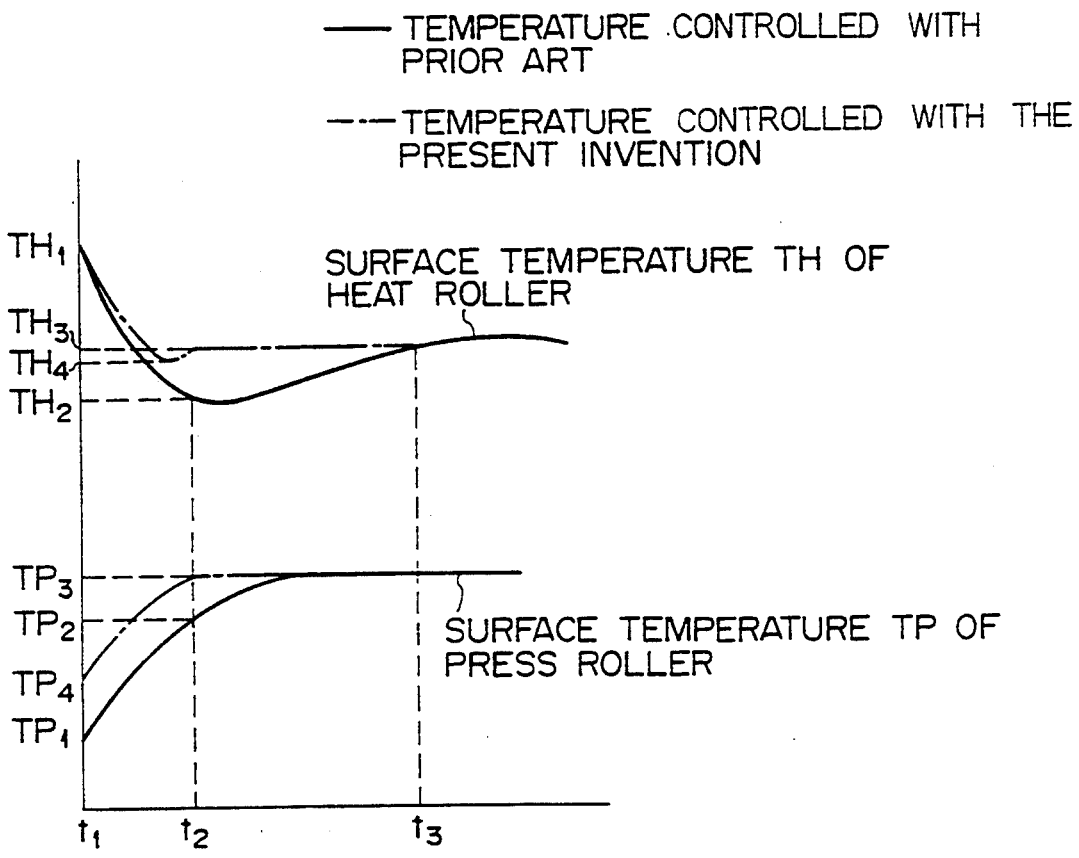
FIG. 11 is a graph comparatively illustrating the roller temperatures controlled by the prior art and the present invention.

FIG. 10 is a flowchart for a second heater control routine executed at predetermined intervals in the controller 210, in place of the first heater control routine shown in FIG. 5. In the second heater control routine, steps 1001 through 1006 are added to the first heater control routine.

At step 1001, the surface temperature of the press roller TP is fetched along with the surface temperature of the heater roller TH.

At step 1002, it is determined whether or not the surface temperature of the press roller TP is lower than the initial stage lower limit temperature $TP_L$. If the determination is negative, that is, if the surface temperature of the press roller TP is higher than the initial stage lower limit temperature $TP_L$, the process from step 504 to step 506 as already described is carried out.

If the determination at step 1002 is affirmative, that is, if the surface temperature of the press roller TP is lower than the initial stage lower limit temperature $TP_L$, the control proceeds to step 1003, at which the heating level of the heater is controlled to be substantially maximum. This is achievable, for example, by giving a command for controlling the heater a 90% duty ratio.

Since a large amount of time is required before the recovery of the surface temperature of the heater roller TH when using a feedback loop control in which the heating level is increased after a temperature drop in the heater roller 201 has been detected, an open loop control is adopted in this case to shorten the temperature recovery time of the heater roller 201.

At step 1004, a temperature deviation DTH between the surface temperature of the heater roller TH obtained by the current execution and THB obtained by the previous execution is calculated.

At step 1005, it is determined whether or not the deviation DTH is negative. If the determination is negative, that is, the temperature deviation DTH is zero or positive (in other words, the surface temperature of the heater roller TH changes from the decreasing to increasing; the process following step 504 is executed as described above.

If the determination at step 1005 is affirmative, the control proceeds to step 1006, at which THB is replaced by TH, and the control is completed.

The fourth aspect relates to temperature control for the press roller 202 after the completion of the copying process, in which if the surface temperature of the press roller TP is lower than an end stage lower limit temperature, the rotation of the motor continues, and stops only when TP has reached an end stage upper limit temperature. If the end stage upper limit temperature is not reached within a predetermined time interval after exceeding the end stage lower limit temperature, the motor also stops rotating.

The fifth, sixth and seventh aspects of the invention combine the first, second and third aspects, respectively, with the fourth aspect.

That is, in the fifth aspect, the surface temperature of the press roller TP is controlled not only at the standby stage but also at the end stage.

In the sixth aspect, the surface temperature of the press roller TP is controlled at a subsequent copying stage after the current copying stage has been completed by the routine for controlling the copying stage temperature of the press roller shown in FIG. 8.

In the seventh aspect, the surface temperature of the heater roller TH is controlled at a subsequent copying stage after the present copying stage has been completed by the second routine for controlling the heater shown in FIG. 9.

According to the first aspect of a control system for a heat fixing apparatus, since the surface temperature of the press roller is always maintained in a range lower than the standby stage upper limit temperature and higher than the standby stage lower limit temperature when the machine is in a standby state, the toner image can be assuredly fixed on the paper even at an initial stage of the copying process. Therefore, it is unnecessary to define a higher standby stage target temperature of the heater roller for heating the press roller, whereby the life of a surface layer member covering a roller surface can be extended.

According to the second aspect of a control system for a heat fixing apparatus, since the paper-feed command is output after heating the press roller by the heater roller when the surface temperature of the press roller is lower than the start-up stage lower limit temperature, the fixing is more assuredly achieved.

According to the third aspect of a control system for a heat fixing apparatus, a time required prior to the issuance of the paper-feed command is shortened at the initial stage of the copying process.

According to the fourth aspect of a control system for a heat fixing apparatus, since the surface temperature of the press roller is maintained higher than a predetermined temperature at a finished stage of the copying process, the toner image can be assuredly fixed on the paper even at the initial stage of a subsequent copying process.

According to the fifth aspect of a control system for a heat fixing apparatus, the surface temperature of the press roller is maintained higher than a predetermined temperature not only at a standby stage but also at an end stage of the copying process.

According to the sixth aspect of a control system for a heat fixing apparatus, since the paper-feed command is output after the press roller has been heated by the heater roller when the surface temperature of the press roller is lower than the initial stage lower limit temperature at the initial stage of a subsequent copying process, even better fixing can be expected.

According to the seventh aspect of a control system for a heat fixing apparatus, a time required before the issuance of a paper-feed command is shortened at a start-up stage of a subsequent copying process.

We claim:

1. A control system for a thermal fixing apparatus used in a copying machine or a printer, comprising:

a heater roller (101) covered by a surface layer made of a material having a release property;

a press roller (102) covered by a surface layer made of a material having a release property and arranged to be in contact with the heater roller (101);

a motor (103) for driving either one of the heater roller (101) and the press roller (102) to rotate both rollers (101, 102) together;

means (104) for detecting a surface temperature of the surface layer covering the heater roller (101);

means (105) for executing a control calculation based on a temperature deviation between the surface temperature of the heater roller (101) detected by the heater roller surface temperature detecting means (104) and a predetermined target temperature; and a heater (106) provided in the center of the heater roller (101); a heating level thereof being controlled in accordance with an output from the heater roller surface temperature control means (105);

characterized in that the system further comprises:

means (107) for detecting a surface temperature of the surface layer covering the press roller (102);

start-up stage lower limit temperature determination means (119) for determining whether or not the surface temperature of the press roller detected by the press roller surface temperature detecting means (107) is lower than a predetermined initial stage lower limit temperature at an initial stage of a copying process; and means (120) for immediately issuing a paper-feed command if it is determined by the start-up stage lower limit temperature determination means (119) that the surface temperature of the press roller is higher than the lower limit temperature, and issuing a command for rotating the motor (103) if it is determined by the start-up stage lower limit temperature determination means (119) that the surface temperature of the press roller is lower than the lower limit temperature, and then issuing a paper-feed command after it has been determined by the initial start-up stage lower limit temperature determination means (119) that the surface temperature of the press roller is higher than the lower limit temperature.

2. A control system for a thermal fixing apparatus as defined by claim 1, characterized in that the system further comprises means (130) for controlling the heater (106) so that a heating level of the heater is maintained at a substantially maximum amount, irrespective of the output from the heater roller surface temperature control means (105), if it is determined by the start-up stage lower limit temperature determination means (119) that the surface temperature of the press roller is lower than the initial stage lower limit temperature, at least until the temperature drop detected by the heat roller surface temperature detecting means (104) has been arrested.

3. A control system for a thermal fixing apparatus used in a copying machine or a printer, comprising:

a heater roller (101) covered by a surface layer made of a material having a release property;

a press roller (102) covered by a surface layer made of a material having a release property and arranged to be in contact with the heater roller (101);

a motor (103) for driving either one of the heater roller (101) and the press roller (102) to rotate both rollers (101, 102) together;

means (104) for detecting a surface temperature of the surface layer covering the heater roller (101);

means (105) for executing a control calculation based on a temperature deviation between the surface temperature of the heater roller (109) detected by the heater roller surface temperature detecting means (104) and a predetermined target temperature;

a heater (106) provided in the center of the heater roller (101), a heating level thereof being controlled in accordance with an output from the heater roller surface temperature control means (105);

means (107) for detecting a surface temperature of the surface layer covering the press roller (102);

means (138) for determining whether or not the surface temperature of the press roller detected by the press roller surface temperature detecting means (107) is higher than a predetermined end stage upper limit temperature at an end stage of the copying process;

means (139) for determining whether or not the surface temperature of the press roller detected by the press roller surface temperature detecting means (107) is lower than a predetermined end stage lower limit temperature at an end stage of the copying process;

means (140) for issuing a command for stopping the rotation of the motor (103) if it is determined by the end stage upper limit temperature determination means (138) that the surface temperature of the press roller is higher than the upper limit temperature and issuing a command for rotating the motor (103) if it is determined by the end stage lower limit temperature determination means (139) that the surface temperature of the press roller is lower than the lower limit temperature;

initial stage lower limit temperature determination means (119) for determining whether or not the surface temperature of the press roller detected by the press roller surface temperature detecting means (107) is lower than a predetermined initial stage lower limit temperature at an initial stage of the copying process; and means (120) for immediately issuing a paper-feed command if it is determined by the initial stage lower limit temperature determination means (119) that the surface temperature of the press roller is higher than the initial stage lower limit temperature, and issuing a command for rotating the motor (103) if it is determined by the initial stage lower limit temperature determination means (119) that the surface temperature of the press roller is lower than the lower limit temperature, and then issuing a paper-feed command after it has been determined by the initial stage lower limit temperature determination means (119) that the surface temperature of the press roller is higher than the initial stage lower limit temperature.

4. A control system for a thermal fixing apparatus as defined by claim 3, characterized in that the system further comprises:

means (130) for controlling the heater (106) so that a heat generation from the heater is maintained at a substantially maximum amount, irrespective of the output from the the heat roller surface temperature control means (105), if it is determined by the initial stage lower limit temperature determination means (119) that the surface temperature of the press roller is lower than the initial stage lower limit temperature, at least until the temperature drop detected by the heat roller surface temperature detecting means (104) has been arrested.

* * * * *

UNITED STATES PATENT AND TRADEMARK OFFICE

CERTIFICATE OF CORRECTION

PATENT NO. : 5,448,339
DATED : September 5, 1995
INVENTOR(S) : Kokaji et al

It is certified that error appears in the above-indentified patent and that said Letters Patent is hereby corrected as shown below:

Column 12, line 3, the word "initial" should be removed.

Column 12, line 36, "(109)" should read --(101)--.

Signed and Sealed this

Twenty-third Day of January, 1996

*Attest:*

Bruce Lehman

BRUCE LEHMAN

*Attesting Officer*

*Commissioner of Patents and Trademarks*